United States Patent [19]

Tinguely et al.

[11] 4,222,558

[45] Sep. 16, 1980

[54] FLIGHT VEHICLE TOY

[75] Inventors: James Tinguely, New York; Edward Snyder, III, Dix Hills, both of N.Y.

[73] Assignee: Ideal Toy Corporation, Hollis, N.Y.

[21] Appl. No.: 16,849

[22] Filed: Mar. 2, 1979

[51] Int. Cl.[3] ..... A63H 27/04

[52] U.S. Cl. ..... 272/31 A

[58] Field of Search ..... 272/31 A, 31 B, 31 R; 273/86 H, 86 B, 102.1 G, 102.1 C, 102.1 D, 102 A, 95 B; 46/77; 35/12 L

[56] References Cited

U.S. PATENT DOCUMENTS

| | | | |
|---|---|---|---|
| 757,567 | 4/1904 | Quinlan | 273/86 H |
| 1,845,613 | 2/1932 | Marx | 273/95 B |
| 2,791,427 | 5/1957 | Johnson | 272/31 A X |
| 3,373,505 | 3/1968 | Tucker | 272/31 A X |
| 3,762,702 | 10/1973 | Keele et al. | 272/31 A |
| 3,799,544 | 3/1974 | Glass et al. | 272/31 R X |
| 3,907,285 | 9/1975 | Lettieri | 272/31 A |

FOREIGN PATENT DOCUMENTS

| | | | |
|---|---|---|---|
| 891369 | 9/1953 | Fed. Rep. of Germany | 273/102.1 C |
| 629834 | 9/1949 | United Kingdom | 273/86 B |
| 1502789 | 3/1978 | United Kingdom | 272/31 A |

*Primary Examiner*—Richard C. Pinkham
*Assistant Examiner*—Arnold W. Kramer
*Attorney, Agent, or Firm*—Richard M. Rabkin

[57] ABSTRACT

A flight vehicle toy includes a pair of vehicles driven about a support stand in a simulated race or "dog" fight through support arms which are rotated from a pair of coactial shafts in the support stand. The toy vehicles are mounted on the support arms through a release mechanism such that when one vehicle imparts the vehicle in front of it during play the front vehicle will be disengaged from its support arm and propelled out of the game. The speed of the respective vehicles can be independently varied by the players and the support arms are dimensioned such that the vehicles can pass above or below one another at all positions during play of the game, except when the vehicles are on a collision course. And, a separate control for the drive motors rotating the arms varies the relative speeds of the two vehicles automatically during the game.

22 Claims, 8 Drawing Figures

10
12
14
16
18
20
22
24
26
28
30
80
82
92
120

FLIGHT VEHICLE TOY

The present invention relates to toy vehicle games and, in particular, to a simulated flight game in which toy vehicles are controlled by a player in a simulated aerial "dog fight".

Toy vehicle flight games or simulators have previously been proposed in a variety of different types of configurations. Such games, for example as shown in U.S. Pat. No. 3,373,505 to Tucker, utilize a pair of aircraft mounted on a central stanchion for rotation in a controlled flight pattern and the speed of the respective planes can be varied by the operators. Such games are not entirely satisfactory since it is not possible for the vehicles to pass one another at all positions in the flight pattern and typically the planes cannot pass over or under one another, as would be necessary to simulate an aerial dog fight. In addition, the planes are fixed to the drive arms and thus a simulated dog fight in which a plane crashes to the ground is not possible.

Other types of toy vehicle flight games using a pair of toy vehicles have also been proposed, but have similar limitations to those of Tucker; such games are shown, for example, in U.S. Pat. Nos. 1,385,634; 2,292,705; 2,465,788; 3,762,702; and 3,907,285.

Other types of flight simulation games in which a single air plane is propelled about a central support member are disclosed for example in U.S. Pat. Nos. 2,901,251; 2,967,706; and 3,731,424.

It is an object of the present invention to provide an improved flight simulation game in which two flight vehicles can pass above or below one another during the game.

Another object of the present invention is to provide a flight vehicle game in which separate toy vehicles are separately controlled in order to vary both their speed and altitude.

A further object of the present invention is to provide a flight vehicle game in which the relative speeds of two flight vehicles are automatically varied during the operation of the game and in which, in addition, the speeds of the vehicles can be separately controlled by the players.

A still further object of the present invention is to provide a flight vehicle game in which the flight vehicles will be propelled away from the game to simulate an air crash, or dog fight, upon an impact with another vehicle.

In accordance with an aspect of the present invention a flight vehicle game includes a support stand, a first hollow shaft rotatably mounted in the stand, and a second shaft coaxial with and rotatably received in the first shaft. A pair of support arms are respectively pivotally mounted on the shafts for rotation therewith and for pivotal movement in vertical planes. The arms extend from the shaft to free ends on which a pair of flight vehicles are respectively mounted. As used herein the term "flight vehicles" refers to any type of toy vehicle suitable for use in this game, such as for example a simulated airplane or space ship. The flight vehicles are mounted on the ends of the arms by cooperating means which releasably mount the vehicles thereon. Such cooperating means include means for propelling the vehicles away from their associated arms when they are impacted by another vehicle.

The coaxial shafts are rotated to propel the vehicles about the support stand through a pair of drive trains from a pair of electric motors which are separately controlled by the players. Means are provided in the circuit of the motors to automatically vary the relative speed of the motors, and thus the airplanes, in addition to the speed control provided for the operators.

The above, and other objects, features and advantages of this invention will be apparent in the following detailed description of an illustrative embodiment of the present invention, as shown in the accompanying drawings, wherein:

FIG. 1 is a perspective view of a flight vehicle toy constructed in accordance with the present invention;

FIG. 1*a* is a similar perspective view, on a smaller scale, showing the alternate modes of passing for the toy vehicles;

Figures 1, 1A:
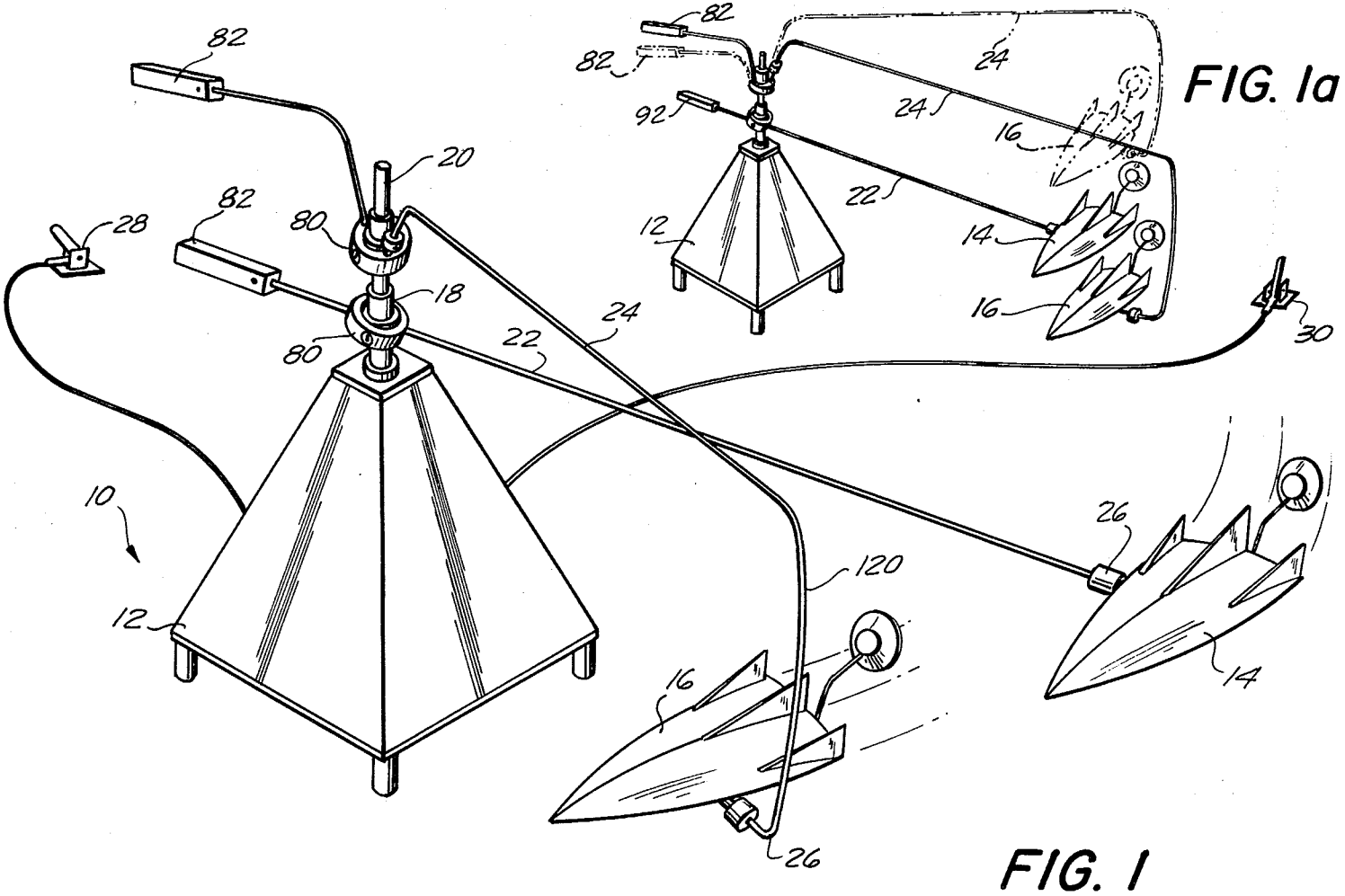

Referring now to the drawings in detail and initially to FIG. 1 thereof, the toy flight vehicle 10 constructed in accordance with the present invention includes a support stand or housing 12 on which the toy vehicles 14, 16 are supported and propelled. The support stand contains the drive mechanism for the game which, as described hereinafter, includes a pair of coaxial shafts 18, 20. Support arms 22, 24 are mounted on these shafts and support the flight vehicles at their free ends 26. During play of the game shafts 18, 20 are rotated in a generally clockwise direction at varying speeds controlled by the players through controllers 28, 30.

Arms 22, 24 are mounted on shafts 18, 20 through a pivotal mounting arrangement which enables the toy vehicles to pass one another. As seen in FIG. 1*a*, the vehicles can pass over or under each other during play of the game without interference. Passing is accomplished by the players causing their respective vehicles to move faster or slower, thereby changing the vertical attitude of the vehicle due to the effects of centrifugal force.

Figure 2:
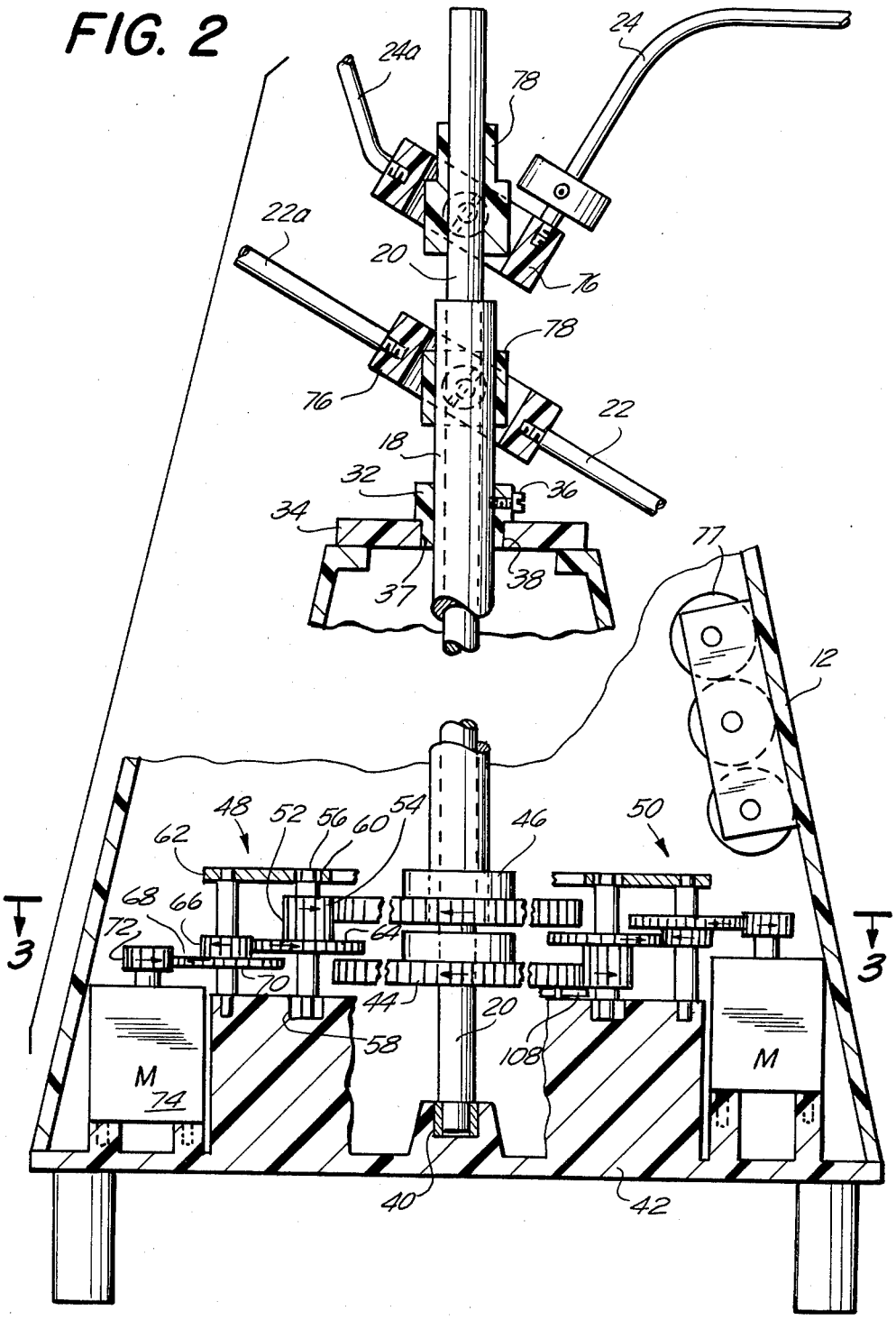
FIG. 2 is an enlarged elevational view, in section, of the toy vehicle game shown in FIG. 1 taken along line 2—2 of FIG. 3.
Figure 3:
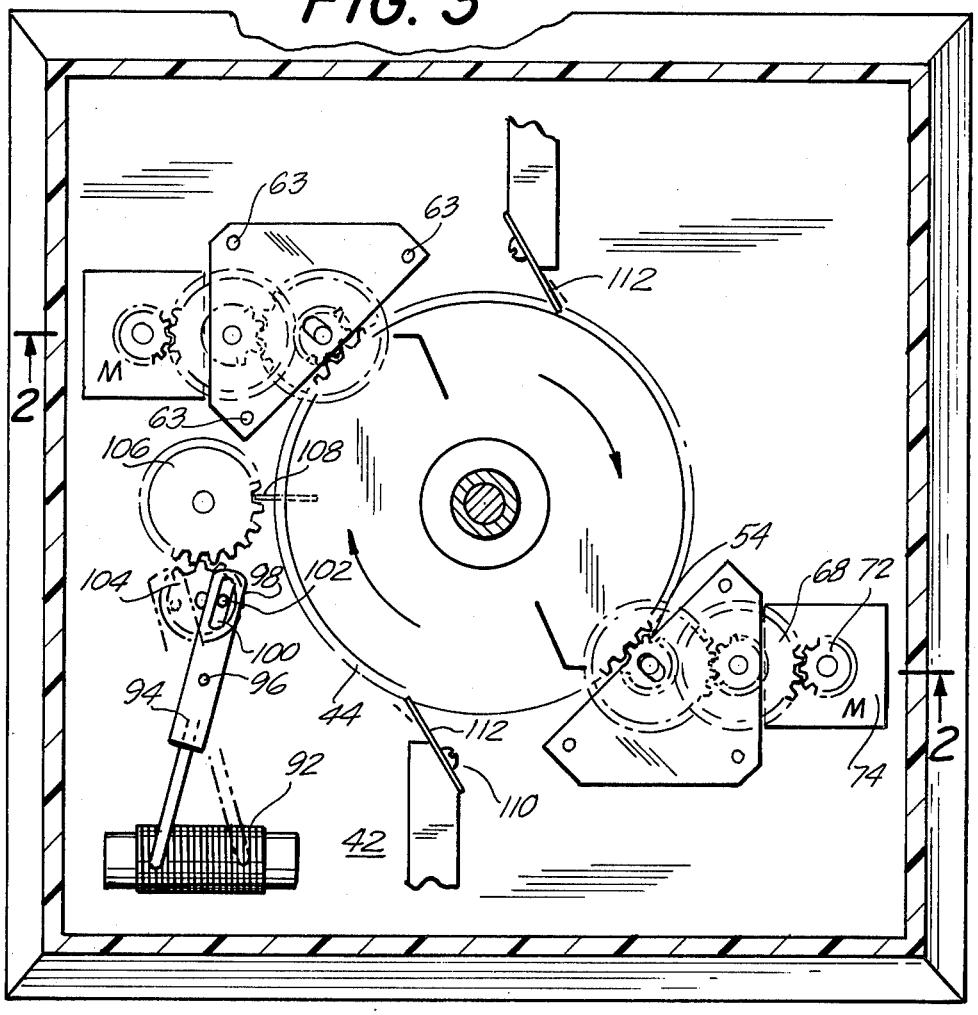
FIG. 3 is a plan view, taken along line 3—3 of FIG. 2.

The drive mechanism for the toy vehicle game of the invention is illustrated in greater detail in FIGS. 2 and 3. As seen therein outer shaft 18 is received in bushing 32 that is rotatably mounted in the top panel 34 of support stand 12. The shaft is maintained in a relatively fixed vertical position by a set screw 36 in bushing 32 which, in turn, includes a stem portion 37 rotatably mounted in opening 38 in top panel 34.

Hollow shaft 18 receives inner solid shaft 20. The lower end of shaft 20 is rotatably mounted in a bearing 40 in the base 42 of support stand 12.

Shaft 20 is keyed to a drive gear 44 and shaft 18 is keyed to a drive gear 46. Both of these drive gears have essentially the same diameter and are driven through substantially identical drive trains 48, 50 with the result that the flight vehicles may be driven at the same angular velocity when the drive motors are operating at the same speed.

Drive train 48 includes a first compound gear 52 whose smaller diameter gear 54 is engaged with gear 46. The opposite ends of the integral shaft 56 of compound gear 52 are respectively located in slots 58, 60 formed in base 42 of stand 12 and in a mounting plate 62. The latter is supported above base 42 in any convenient manner, as for example by support pins 63. The larger diameter gear 64 of compound gear 52 is engaged with the smaller gear 66 of a second compound gear 68. The larger gear 70 of compound gear 68 is engaged with the output gear 72 of motor 74.

Figure 7:
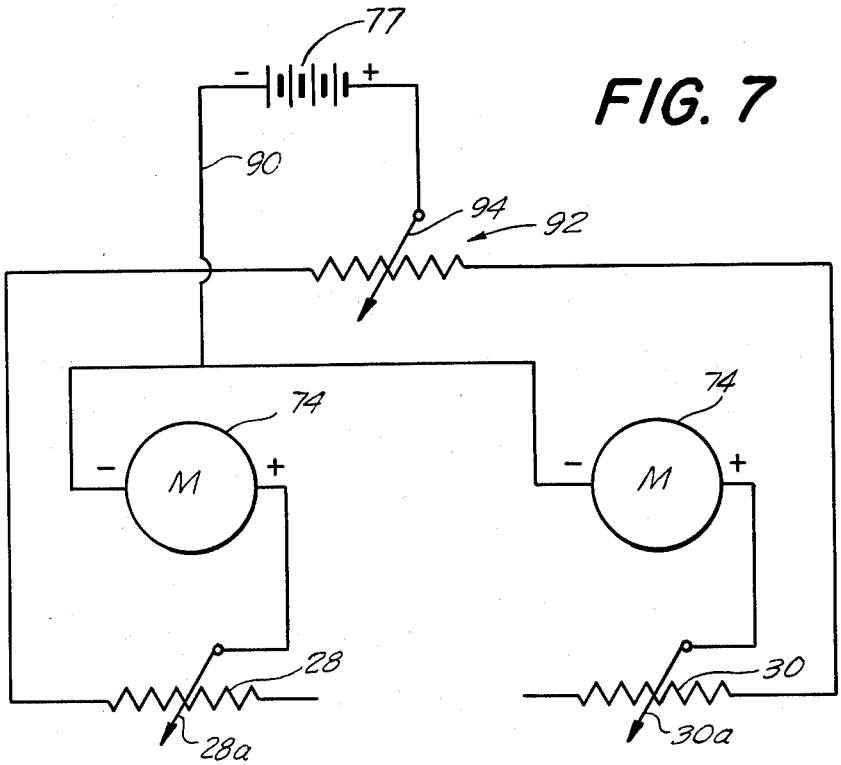
FIG. 7 is a schematic circuit diagram for the game of the invention.

Motor 74 is connected through the circuit illustrated in FIG. 7 to a bank of batteries 76 which supply current to the motor. When motor 74 is operated it drives gear 46 through gear train 48 and thus drives shaft 18.

Drive train 50 is identical to drive train 48 and therefore is not described in detail. The only difference is that the gears (which are identified by reference numbers corresponding to those of the gears in gear train 48) are inverted, as shown in FIG. 2, for the sake of compactness and convenience in construction.

Because compound gears 52 are mounted in slots 58, 60 the drive shafts 18, 20 and their associated support arms can be rotated, e.g. manually, when their associated drive motors are stopped since the compound gear will slide in its mounting slots out of engagement with its associated gear 44 or 46. Likewise, should one vehicle being actuated at high speed collide with the rear of a slower moving vehicle the relative movement between the gears provided by slots 58, 60 will prevent damage to the drive train.

Support arms 22, 24 are pivotally mounted on the upper ends of shafts 18, 20 as shown most clearly in FIG. 2. Each arm is fixed to a ring or bushing 76 that is pivotally mounted on an associated bushing 78 fixed to the respective shafts. The pivot mounting of rings 76 on bushings 78 can be formed in any convenient manner, and it has been found that a pair of simple threaded screws 80, as seen in FIG. 1, is sufficient.

Arms 22, 24 include extensions **22*a*, 24*a* which are also secured to pivot rings 76. The rear ends of these arms have weights 82 mounted thereon which act as counterweights to the arms and the toy vehicles mounted thereon. The weight of the counterweights 82 and their associated arm extensions approximately equals the combined weight of the remainder of the arm and toy vehicle on the opposite side of the pivot so that the vehicles are balanced. This balancing of the vehicles enables them to be more easily controlled at relatively low angular velocities of, for example, ten to forty rmp so that the players can readily vary the vertical positions of the toy vehicles relative to one another by varying slightly their angular velocity. That is, as shafts 18, 20 rotate at increased speeds the effect of the counterbalancing weights and the weights of the toy vehicles themselves will cause the toy vehicles to rise, while a decrease in speed will cause the toy vehicle's position to lower, as illustrated for example in solid and phantom lines for the vehicle 16 in FIG. 1*a*. Of course the range of vertical movement of the toy vehicles is limited by the diameter of rings 76 since the rings will engage their associated shaft or bushing 78 in extreme up or down positions, as shown in FIG. 2**.

Each of the motors 74 is under the separate control of one of the controllers 28, 30 so that each toy vehicle can be associated with one player in playing the game either as a race game or as a dog fight game. The circuit for this arrangement is shown in FIG. 7. The controllers, shown schematically therein, are variable resistors with the handles **28*a*, 30*a* thereof being electrical contacts whose position can be varied across the resistance of the controller. The motors are connected to a common lead 90 which is connected to one side of the bank of batteries 77. The opposite side of the bank of batteries is connected to the opposite sides of the motors, through the controllers 28, 30. In a preferred embodiment of the invention, an intermediate variable resistor 92 is provided which includes a movable contact element 94. With this arrangement, by varying the position of the contact element 94 on resistor 92 the supply of current to the respective motors 74 can be divided and varied so that the relative base speed of the two toy vehicles can be varied, in addition to the variation of the speed affected by the individual controllers 28, 30. Preferably this variably positionable contact 94** is controlled so that the base velocity of the vehicles varies continuously during the play of the game. This variation in the base velocity adds an element of difficulty and unpredictability to the play of the game in controlling the respective positions of the vehicles.

Contact 94 is shown in greater detail in FIG. 3, and consists of an oscillating arm which is pivotally mounted on a pin 96 in base 42 of support stand 12. The rear end 98 of the contact has an elongated slot 100 formed therein which receives a pin 102 extending upwardly from a gear 104 rotatably mounted in the support stand. This gear is engaged with a spur gear 106 that is also rotatably mounted in the support stand. A rigid pin 108 is fixed to one of the gears 44, 46 and extends radially therefrom for rotation therewith, and it is located to engage gear 106. Thus, once each revolution of the gear, e.g. gear 44 shown in FIG. 3, pin 108 will engage gear 106 and move that gear through a portion of a revolution as measured by the travel of the pin 108 while engaged with the teeth of gear 106. This will cause a slight rotation of the gear 104 and as a result a slight movement of contact 94, with the result that the current supplied to the motors 74 is varied.

If desired noise makers 110 can be mounted in the game for engagement with gears 44, 46, as seen in FIG. 3. These noise makers may simply consist of a metal leaf 112 positioned to engage the teeth of gears 44 and 46.

With this arrangement the players can cause their toy vehicles 14, 16 to move at varying speeds and pass one another. As seen in FIGS. 1 and **1*a* arms 22, 24 are constructed such that the toy vehicles can pass one another regardless of their vertical attitude with respect to one another without arms 22, 24 interfering. Specifically, arm 24 is essentially an L-shaped arm with the height of its short leg 120 being somewhat greater than the largest arc which can be transcribed by the free end 26 of arm 22 between its two extreme upper and lower positions limited by engagement of ring 76 with shaft 18 or bushing 78. In this manner the flight vehicles can pass one another by flying over or below the other vehicle. However the flight paths at the ends 26** of the support arms can intercept one another so that the flight vehicles can contact each other.

Figure 4:
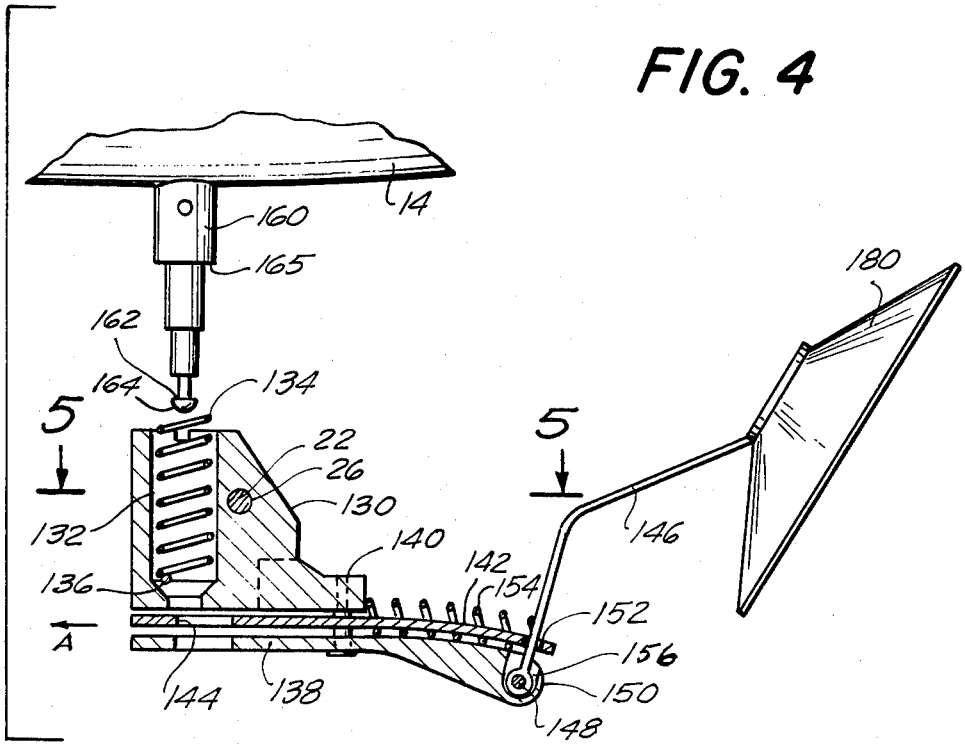
FIG. 4 is an enlarged sectional view of the mounting arrangement for the toy vehicles on the end of the support arms.
Figure 5:
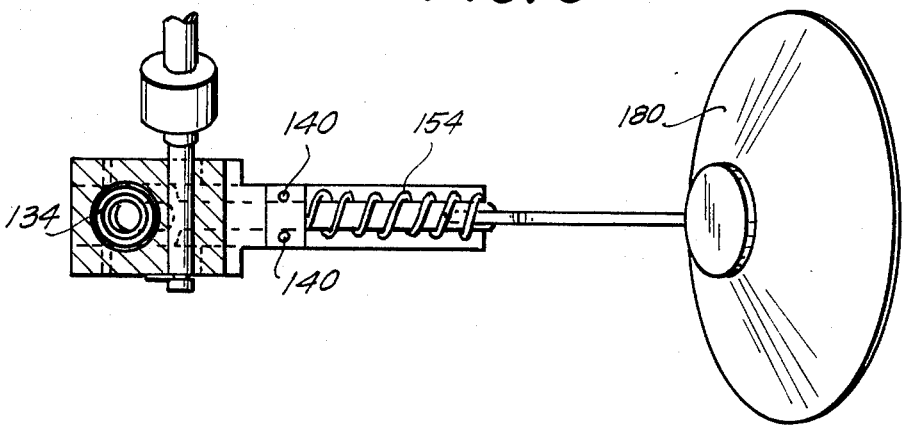
FIG. 5 is a plan view taken along line 5—5 of FIG. 4.
Figure 6:
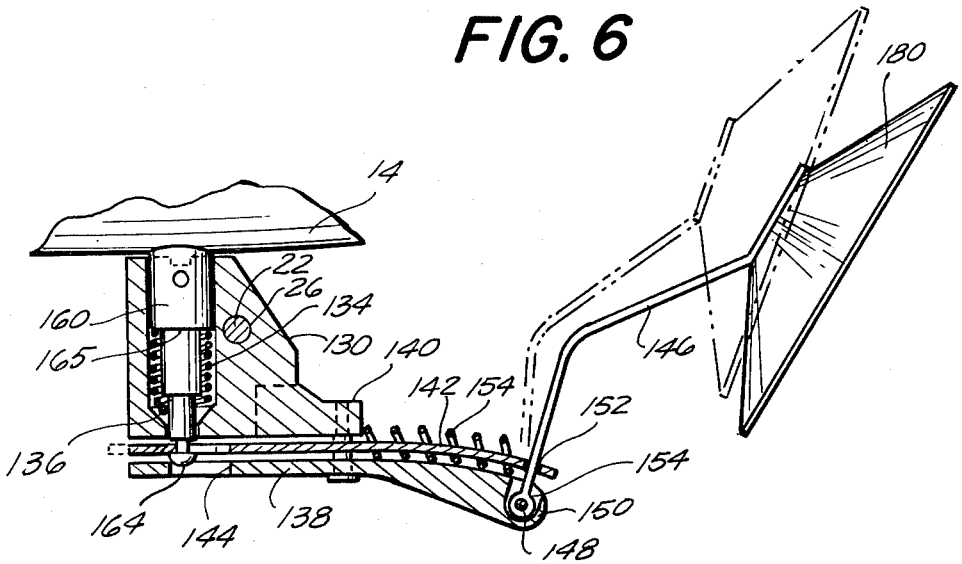
FIG. 6 is a side sectional view, similar to FIG. 4, showing a toy vehicle mounted on its associated support arm; and also showing release of the toy vehicle in phantom lines.

The ends 26 of the support arms, and the toy vehicles, have cooperating means which enable the toy vehicles to be proppelled from the arms when the vehicles collide. This cooperating means arrangement is shown in FIGS. 4–6, and includes a support block 130 mounted on the free ends 26 of the support arms (for example the arm 22 shown in FIG. 4). This support block has a vertical bore 132 in which a coil spring 134 is mounted. The coil spring is held in a fixed position by a pin 136 extending transversely of the bore between two of the coils of the spring. A second support member 138 is fixed to the support 130 by a pair of pins 140 which are laterally spaced from one another, as seen in FIG. 5. A slide bar 142 is positioned between support members 130, 138 and has an elongated latching slot 144 formed at one end thereof, essentially in alignment with bore 132. A contact member 146 is pivotally mounted on a pin 148 at the rear end 150 of support member 138. This contact member extends through an opening 152 in the rear end of slide bar 142. A coil spring 154 surrounds slide bar 142 between support member 130 and contact member 146 and biases the latter to its rearmost position in recess 156. The position of the contact member is limited by the extremes of the recess 156.

Each of the toy vehicles includes a mounting stem 160 which is dimensioned to be received within the confines of coil spring 134. The lower end of stem 160 has an upwardly facing shoulder 162 and a cam surface 164 on its lower end. To connect the flight vehicle to the support member 130 stem 160 is inserted in spring 134 and depressed until cam surface 164 moves latch bar 142 to the left, as indicated by the arrow A in FIG. 4, so that the latch bar can pass over and engage shoulder 162. Spring 154 will insure that the latch bar slides to the right to engage against shoulder 162 after the shoulder has passed below the latch bar. At the same time spring 134 is compressed against the downwardly facing shoulder 165 of the flight vehicle's stem 160 and held in its compressed position.

During play of the game, when a toy vehicle approaches another toy vehicle so that its contact member 146 (which has a simulated dish antenna 180 on its end) is contacted by the forward end of the other toy vehicle, this will pivot latch member 146 in the counterclockwise direction of FIG. 4, moving slide bar 142 to the left. This releases engagement of the edge of the slot with the shoulder of the stem 160 and causes spring 134 to propel the toy vehicle upwardly and away from support block 130.

Accordingly it is seen that a relatively simply constructed flight vehicle game is provided in which the vehicles in the game can be separately controlled by the players, subject to an apparently random speed variation as a result of the continual variation of the relative speed of the toy vehicles with respect to one another. In addition, a more realistic game is provided in that the vehicles will be propelled away from the game upon collision to more closely simulate a dog fight.

Although an illustrative embodiment of the present invention has been described herein with reference to the accompanying drawings, it is to be understood that the invention is not limited to that precise embodiment, and that various changes and modifications may be effected therein by one skilled in the art without departing from the scope or spirit of this invention.

What is claimed is:

1. A flight vehicle toy comprising a support stand, a first hollow shaft rotatably mounted in said stand; a second shaft coaxial with and rotatably received in said first shaft; a pair of support arms respectively mounted on said shafts for rotation therewith and extending from said shafts to free ends; a pair of flight vehicles; cooperating means on said arms and vehicles for releasably mounting said vehicles on said arms including means for propelling the vehicle away from its associated arm upon an impact with the other vehicle; and means for rotating said shafts.

2. A flight vehicle toy as defined in claim 1 including means for pivotally mounting said arms to their associated shafts for pivotal movement about a horizontal axis whereby said vehicles are free to move vertically during rotation of the shafts.

3. A flight vehicle toy as defined in claim 2 including operator controlled means for varying the speed of rotation of said shafts.

4. A flight vehicle toy as defined in claim 3 wherein said arms each include counterbalance means on the side of said pivotal mounting means opposite the vehicle for counterbalancing the weight of the arm and vehicle.

5. A flight vehicle toy as defined in claim 4 including means for automatically varying the relative speeds of rotation of said shafts, thereby to automatically vary the relative speed and elevation of the vehicles.

6. A flight vehicle toy as defined in claim 5 wherein said means for rotating the shafts comprises a pair of electric drive motors respectively drivingly engaged with said shafts; a variable resistor connected between the motors including a movable contact, and means operatively connected to one of said shafts for varying the position of said contact in the resistor during rotation of said one shaft.

7. A flight vehicle toy as defined in claim 1 wherein said cooperating means each includes a frame mounted on the free end of said arms, and having a bore formed therein, said vehicles each having a stem adapted to be received in said bore, releasable latch means for engaging said stem in said bore and including a contact member for releasing engagement with the stem when the contact member engages another vehicle, said propelling means comprising spring means engaged between the frame and vehicle when said stem is in the bore.

8. A flight vehicle toy as defined in claim 7 wherein said latch means comprises a slide member having an elongated slot formed therein positioned in alignment with said bore; said stems each having a shoulder formed thereon adapted to be engaged with an edge of said slot when the stem is inserted in the bore; and said contact member comprising a lever mounted on said frame member for limited pivotal movement and being connected to said slide, and spring means for biasing said contact lever to a first position in which the slide is held in latching engagement with said stem.

9. A flight vehicle toy as defined in claim 1 wherein one of said arms is straight and the other arm is generally L-shaped, said arms being dimensioned such that their free ends are located at approximately the same distance from said shafts whereby the vehicles may pass each other at any relative vertical position in which the free ends themselves would not collide.

10. A flight vehicle toy as defined in claim 1 wherein said means for rotating the shafts includes a pair of electric motors and a separate drive train between each of said motors and shafts, said drive trains including means for permitting said arms to rotate when their associated motors are stopped or rotating slower than the arm.

11. A flight vehicle toy comprising a support stand, a first hollow shaft rotatably mounted in said stand, a second shaft coaxial with and rotatably received in said first shaft; a pair of support arms; means for independently pivotally mounting said arms on the respective shafts for pivotal movement in vertical planes in limited predetermined arcs as said arms rotate with the shaft; said arms extending from said pivot means to free ends; simulated flight vehicles mounted on said free ends of the arms; means for rotating said shafts and operator controlled means for separately controlling the speed of rotation of said shafts; and said arms being dimensioned and shaped whereby said free ends of the arms are located at approximately the same radial distance from said shafts and only the paths of travel of the free ends can intersect during operation of the game whereby the vehicles can pass one another regardless of their speed or relative vertical positions except when the vehicles themselves collide; one of said arms being straight and the other of said arms being generally L-shaped, having a long leg and a short leg, said short leg having a height which is greater than chord of the largest arc transcribed by the straight arm when pivoting in a vertical plane on said pivot means.

12. A flight vehicle toy as defined in claim 11 wherein said arms include counterbalance means on the side of said pivotal mounting means opposite the vehicle for counterbalancing the weight of the arm and vehicle whereby the vehicles are controllable at low RPM.

13. A flight vehicle toy comprising a support stand, a first hollow shaft rotatably mounted in said stand, a second shaft coaxial with and rotatably received in said first shaft; a pair of support arms; means for independently pivotally mounting said arms on the respective shafts for pivotal movement in vertical planes in limited predetermined arcs as said arms rotate with the shafts; said arms extending from said pivot means to free ends; flight vehicles mounted on said free ends of the arms; means for rotating said shafts and operator controlled means for separately controlling the speed of rotation of said shafts; and said arms being dimensioned and shaped whereby said free ends of the arms are located at approximately the same radial distance from said shafts and only the paths of travel of the free ends can intersect during operation of the game whereby the vehicles may pass one another regardless of their speed or relative vertical positions except when the vehicles themselves collide; and means for automatically varying the relative speeds of rotation of said shafts, thereby to automatically vary the relative speed and the elevation of the vehicles.

14. A flight vehicle toy as defined in claim 13 wherein said means for rotating the shafts comprises a pair of electric drive motors respectively drivingly engaged with said shafts, a battery, said motors each having a pair of terminals with corresponding terminals in each motor being connected to one end of the battery, a variable resistance element connected between the other terminals of the motors and including a movable contact connected to the other end of the battery and means connecting said movable contact with one of said shafts for varying the position of the contact in the resistor as the shaft rotates, thereby to automatically vary the relative speed of rotation of said vehicles.

15. A flight vehicle toy as defined in claim 14 including a separate drive train between each of said motors and shafts; said drive trains including means for permitting said arms to rotate if their associated motors are stopped or rotating at a speed slower than the arm.

16. A flight vehicle toy as defined in claims 11, 12, 13, 14 or 15 including cooperating means on said arms and vehicles for releasably mounting said vehicles on said arms, including means for propelling the vehicles away from their associated arms upon an impact with the other vehicle.

17. A flight vehicle toy as defined in claim 16 wherein said cooperating means each includes a frame mounted on the free end of said arms and having a bore formed therein, said vehicles each having a stem adapted to be received in said bore, releasable latch means for engaging said stem in said bore and including a contact member for releasing engagement with the stem when the contact member engages another vehicle, said propelling means comprising spring means engaged between the frame and vehicle when said stem is in the bore.

18. A flight vehicle toy as defined in claim 17 wherein said latch means comprises a slide member having an elongated slot formed therein positioned in alignment with said bore; said stems each having a shoulder formed thereon adapted to be engaged with an edge of said slot when the stem is inserted in the bore; and said contact member comprising a lever mounted on said frame member for limited pivotal movement and being connected to said slide, and spring means for biasing said contact lever to a first position in which the slide is held in latching engagement with said stem.

19. A flight vehicle toy comprising a support stand, a first hollow shaft rotatably mounted in said stand, a second shaft coaxial with and rotatably received in said first shaft; a pair of support arms mounted on said shafts for rotation therewith; toy flight vehicles mounted on said arms and means for rotating said shafts and thereby rotating said arms and flight vehicles about the support stand including a pair of electric drive motors operatively connected to said shafts for driving the shafts and means for automatically varying the relative speeds of rotation of said drive motors in response to rotation of one of their respective shafts.

20. A flight vehicle toy as defined in claim 19 including operator control means for separately controlling the output speed of said motors.

21. A flight vehicle toy as defined in any of claims 19 or 20 wherein said means for automatically varying the relative speeds of said drive motors comprises a variable resistance connected between said motors and a source of current; said variable resistance including a movable contact connected to said source of current, and means operatively connecting said contact to one of said shafts for oscillating the contact on the resistor to vary the resistance applied to each motor.

22. A flight vehicle toy as defined in claim 21 including a separate drive train between each of said motors and shafts; said drive trains including means for permitting said arms to rotate if their associated motors are stopped or rotating at a speed slower than the arm.

* * * * *